US006402317B2

(12) United States Patent
Yanagawa et al.

(10) Patent No.: US 6,402,317 B2
(45) Date of Patent: Jun. 11, 2002

(54) INK-JET RECORDING OF IMAGES WITH IMPROVED CLARITY OF IMAGES

(75) Inventors: Nobuyuki Yanagawa; Yasuo Katano; Aino Noguchi, all of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/891,658

(22) Filed: Jun. 27, 2001

Related U.S. Application Data

(62) Division of application No. 09/220,442, filed on Dec. 24, 1998, now Pat. No. 6,257,716.

(30) Foreign Application Priority Data

Dec. 26, 1997 (JP) ..... 9-359208
Dec. 26, 1997 (JP) ..... 9-359308

(51) Int. Cl.[7] ..... B41J 2/01
(52) U.S. Cl. ..... 347/104; 347/103
(58) Field of Search ..... 347/95, 96, 98, 347/101, 102, 103, 105, 106, 104

(56) References Cited

FOREIGN PATENT DOCUMENTS

JP 07-89067 * 4/1995

* cited by examiner

*Primary Examiner*—Ren Yan
(74) *Attorney, Agent, or Firm*—Oblon, Spivak, McClelland, Maier & Neustadt, P.C.

(57) ABSTRACT

An ink-jet image recording apparatus including a sheet feed mechanism feeding a recording sheet along a sheet feed path; an ink-jet recording head provided in the sheet feet path so as to record an image on the recording sheet transported through the sheet feed path, by projecting ink droplets to the recording sheet; and an ink viscosity adjusting mechanism provided in the sheet feet path and providing a substance layer on the recording sheet at an upstream side of the recording head, such that the recording head records the image through the substance layer. The ink viscosity adjusting mechanism further removes the substance layer from the recording sheet at a downstream side of the recording head after the image is recorded.

17 Claims, 9 Drawing Sheets

INK-JET RECORDING OF IMAGES WITH IMPROVED CLARITY OF IMAGES

This application is a division of application Ser. No. 09/220,442, filed on Dec. 24, 1998, now U.S. Pat. No. 6,257,716.

BACKGROUND OF THE INVENTION

The present invention generally relates to recording of information on a recording sheet and more particularly to the art of ink-jet recording in which visual recording of an image is made on a recording paper by impinging ink droplets thereon.

In the art of ink-jet recording, in which recording of image is made by impinging color ink droplets on a recording paper in response to an image signal, it is important to avoid spreading of the ink on the recording paper. While the problem of spreading of the ink on the recording paper is controlled satisfactorily when a specially produced recording paper is used at the time of ink-jet recording, the problem appears more or less conspicuously when an ordinary recording paper, including those used commonly for xerographic recording of images, is used for the recording medium of the ink-jet recording process.

In order to suppress the foregoing problem of spreading of ink on the recording paper at the time of ink-jet recording, it is proposed to record an ink image once on an intermediate recording medium and then transfer the ink image thus formed to an ordinary recording paper, as disclosed in the Japanese Laid-Open Patent Publication 7-89067. In such a process, it is expected that the ink on the intermediate recording medium increases the viscosity due to the evaporation of the solvent in the ink while the ink is still on the intermediate recording medium.

Unfortunately, this conventional process is inherently ineffective for avoiding the problem of spreading of ink due to the fundamental nature of ink-jet recording, which relies upon the use of an ink containing little resin or solid component. It should be noted that the use of a resin component or solid component in the ink would inevitably invite the problem of clogging of the ink-jet nozzle. Further, the foregoing conventional process has a tendency of incomplete image transfer, and associated therewith, there arises a need of cleaning the intermediate medium each time the intermediate ink image is transferred, for removing the remaining ink from the intermediate medium. Further, the intermediate medium tends to collect particles of the recording paper, while the particles thus collected tend to cause the problem of clogging of the ink-jet nozzle.

Further, there is an ink-jet process, as disclosed in the Japanese Laid-Open Patent Publication 6-92009, which avoids the spreading of ink on the recording paper by projecting a curing agent substantially simultaneously to the ink droplets on the recording paper, such that a droplet of the curing agent hits the portion of the recording paper to which an ink droplet from the ink-jet nozzle is directed. Thereby, the curing agent causes a curing of the ink droplet.

This process, while being able to eliminate the problem of spreading of the ink on the recording paper, has a drawback in that it requires an additional nozzle for projecting the curing agent in alignment with the ink droplets, and the cost of the ink-jet recording is inevitably increased. Further, the foregoing process of using a curing agent generally requires time for the ink to be cured, and the speed of the image recording is inevitably slowed down.

Further, there is an ink-jet process that avoids the spreading of ink on the recording paper as disclosed in the Japanese Laid-Open Patent Publication 5-96720, by uniformly applying an agent on the surface of the recording paper prior to the ink-jet recording, such that the ink droplets landed on the recording paper experience a curing or fixing as a result of contact with the curing agent.

While this process is effective for avoiding the spreading of ink image on the recording paper, the process has a drawback in that the curing agent, being a substance soluble to water or oil, tends to react with the solvent of the ink and the recorded image may be degraded as a result of such a reaction. In other words, the image recorded on the recording paper according to such a process is not stable and may be degraded with time.

SUMMARY OF THE INVENTION

Accordingly, it is a general object of the present invention to provide a novel and useful ink-jet image recording method and apparatus wherein the foregoing problems are eliminated.

Another object of the present invention is to provide an ink-jet image recording method and apparatus wherein the problem of spreading of ink on the recording paper is effectively eliminated even when a commonly used, ordinary recording paper is used for recording the ink image.

Another object of the present invention is to provide an ink-jet image recording method and apparatus wherein the image recorded on a recording paper is stable against contacting with water.

Another object of the present invention is to provide an ink-jet image recording method and apparatus wherein the image recorded on a recording paper is preserved with excellent durability.

Another object of the present invention is to provide a method of recording an image on a recording sheet by an ink, said method comprising the steps of:

- forming a layer of a substance on said recording sheet, said substance causing an increase of viscosity of said ink when contacted with said ink;
- recording an image on said recording sheet by projecting thereto said ink in the form of an ink droplet; and
- removing said substance from said recording sheet after said step of recording said image.

Another object of the present invention is to provide an ink-jet image recording apparatus, comprising:

- a sheet feed mechanism feeding a recording sheet along a sheet feed path;
- an ink-jet recording head provided in said sheet feed path so as to record an image on said recording sheet transported through said sheet feed path, by projecting ink droplets to said recording sheet;
- an ink viscosity adjusting mechanism provided in said sheet feed path, said ink viscosity adjusting mechanism providing a substance layer on said recording sheet at an upstream side of said ink-jet recording head, such that said ink-jet recording head records said image through said substance layer;
- said ink viscosity adjusting mechanism further removing said substance layer from said recording sheet at a downstream side of said ink-jet recording head after said image is recorded on said recording sheet through said substance layer.

Another object of the present invention is to provide a method of recording an image on a recording sheet by an ink, said method comprising the steps of:

- forming a layer of a substance on a recording medium, said substance causing an increase of viscosity of said ink when contacted with said ink;

recording an image on said recording medium by projecting thereto said ink in the form of an ink droplet; and transferring said image from said recording medium to said recording sheet.

Another object of the present invention is to provide an ink-jet image recording apparatus, comprising:

a sheet feed mechanism feeding a recording sheet along a sheet feed path;

an image transfer medium disposed in said sheet feed path so as to make a contact with said recording sheet transported through said sheet feed path, said image transfer medium being moved along a circuitous path;

an ink-jet recording head provided adjacent to said image transfer medium so as to record an image thereon, by projecting ink droplets to said image transfer medium;

an ink viscosity adjusting mechanism provided on said image transfer medium, said ink viscosity adjusting mechanism providing a substance layer on said image transfer medium at an upstream side of said circuitous path with respect to said ink-jet recording head, such that said ink-jet recording head records said image on said image transfer medium through said substance layer, wherein said substance layer increases a viscosity of said ink droplet when contacted with said ink droplet.

According to the present invention, the ink droplets increase the viscosity thereof when impinged upon the substance layer, and the problem of spreading of the ink droplets on the surface of the recording sheet is successfully eliminated even when a commonly used, ordinary recording paper is used for the recording sheet. Thereby, a sharply defined, clear image recording becomes possible.

Other objects and further features of the present invention will become apparent from the following detailed description when read in conjunction with the attached drawings.

DETAILED DESCRIPTION OF THE PREFERRED EMBODIMENT

[First Embodiment]

FIGS. 1A–1D show the principle of the ink-jet recording process according to a first embodiment of the present invention.

Figure 1A:
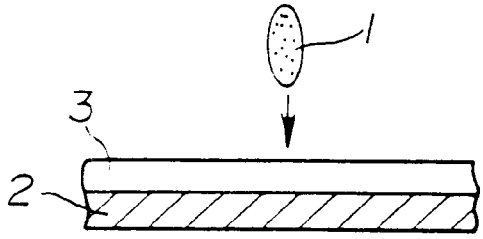
FIGS. 1A–1D are diagrams showing the principle of ink-jet recording process according to a first embodiment of the present invention.

Referring to FIG. 1A, a commonly used, ordinary recording paper 2, which may be the one used extensively in xerographic printers, is covered by a film 3 of polyvinyl alcohol, and an ink droplet 1 of a water-color ink, ejected from an ink-jet nozzle not illustrated, is impinged upon the recording paper 2 via the polyvinyl alcohol film 3.

Figure 1B:
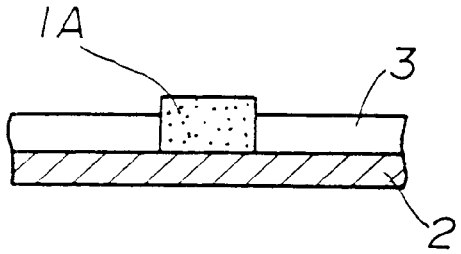
Figure 1C:
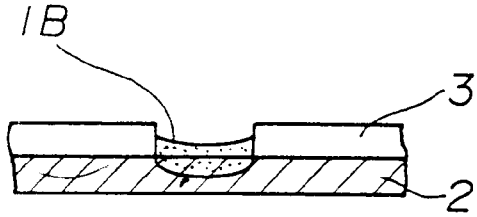

When the ink droplet 1 reaches the polyvinyl alcohol film 3, the ink droplet 1 immediately induces a swelling or melting of the polyvinyl alcohol film 3 in correspondence to a region 1A where the ink droplet 1 has landed as indicated in FIG. 1B, and there is formed a viscous ink droplet 1B in correspondence to the foregoing region 1A as indicated in FIG. 1C.

Figure 1D:
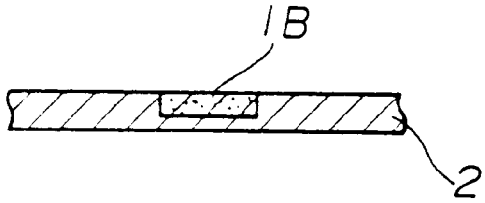

The viscous ink droplet 1B thus formed then penetrates into the recording sheet 2 in the step of FIG. 1D and forms a recording mark, wherein it should be noted that the lateral spreading or diffusion of the ink is effectively prevented as a result of the increased viscosity of the ink droplet 1B. After the recording of the recording mark in the step of FIG. 1D, it should be noted that the polyvinyl alcohol film 3 is removed, leaving a hole in the film 3 in correspondence to the region 1A.

Figure 2:
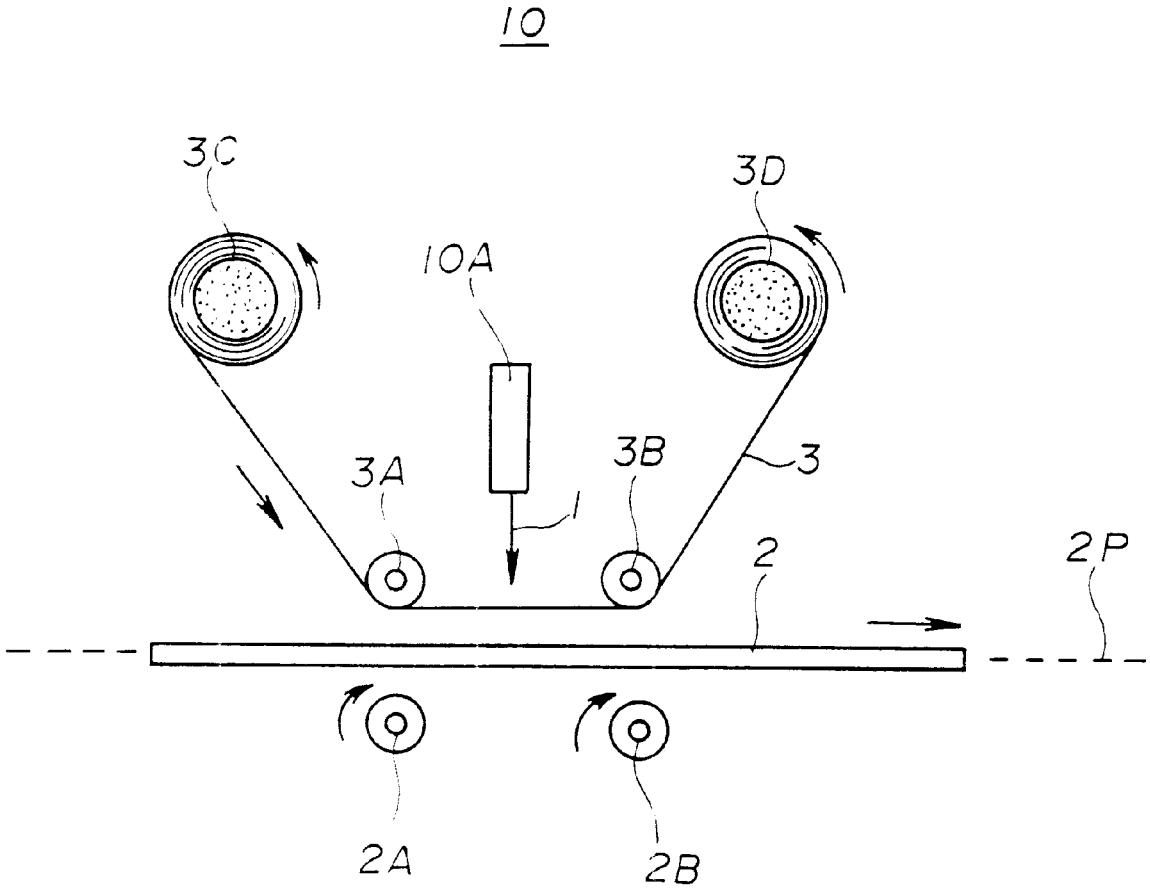
FIG. 2 is a diagram showing the construction of an ink-jet recording apparatus according to the first embodiment.

FIG. 2 shows the construction of an ink-jet image recording apparatus 10 according to the present embodiment, designed for carrying out the process of FIGS. 1A–1D, wherein those parts corresponding to the parts described previously are designated by the same reference numerals and the description thereof will be omitted.

Referring to FIG. 2, the ink-jet image recording apparatus 10 includes feed rollers 2A and 2B at a first side of a paper feed path 2P for feeding the recording paper 2, and there is provided an ink-jet head 10A at a second, opposite side of the paper feed path 2P such that the ink-jet head 10A carries out an ink-jet recording on the recording paper 2 on the paper feed path 2P by ejecting the ink droplets 1 of a water-color ink.

Further, the ink-jet image recording apparatus 10 of FIG. 2 includes additional feed rollers 3A and 3B at the second side respectively in correspondence to the feed rollers 2A and 2B, and the feed rollers 3A and 3B feed the polyvinyl alcohol film 3 such that the polyvinyl alcohol film 3 is contacted intimately with the recording paper 2 at the second side of the recording paper 2. It should be noted that the polyvinyl alcohol film 3 is supplied from the supply roll 3C and is taken up by the take-up roll 3D, wherein the supply roll 3C and the take-up roll 3D are provided at the second side of the recording paper 2.

While the polyvinyl alcohol film 3 is represented as being separated from the paper 2 in FIG. 2, this is merely for the sake of representation and the film 3 is fed together with the paper 2 in intimate contact therewith such that there is no air or gap between the film 3 and the paper 2. Thus, it should be noted that the feed roller 2A engages with the feed roller 3A firmly, with the recording paper 2 and the polyvinyl alcohol film 3 interposed therebetween. Similarly, the feed roller 2B engages with the feed roller 3B firmly, with the recording paper 2 and the polyvinyl alcohol film 3 interposed therebetween.

Preferably, the polyvinyl alcohol film 3 has a thickness of 1–50 μm, more preferably a thickness of 4–10 μm, most preferably a thickness of about 5 μm. When the thickness of the polyvinyl alcohol film 3 is excessive, the swelling or melting in the step of FIG. 1B tends to become incomplete. When the thickness of the polyvinyl alcohol film 3 is too small, there arises a difficulty of handling the film 3.

By using the construction of FIG. 2, a clearly defined image is recorded on the recording paper 2 without spreading of the ink, even in such a case in which a commonly used recording paper such as Ricoh PPC for xerographic copiers and laser printers is used for the paper 2.

As the polyvinyl alcohol film 3 is removed from the recording paper 2 after the ink-jet recording, no resin component remains on the recording paper 2 and the degradation of the recorded image, caused by the resin film 3 when contacted with water or oil, is effectively eliminated. Thereby, the ink image recorded on the recording paper 2 remains stably for long time.

[Second Embodiment]

Figure 3A:
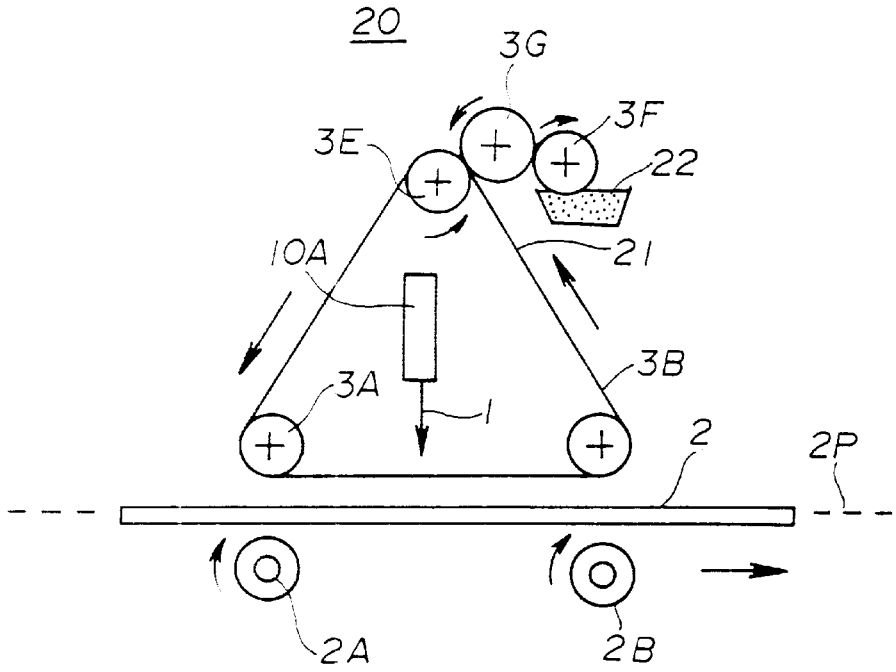
FIGS. 3A–3C are diagrams showing the construction of an ink-jet recording apparatus according to a second embodiment of the present invention.
Figure 3B:
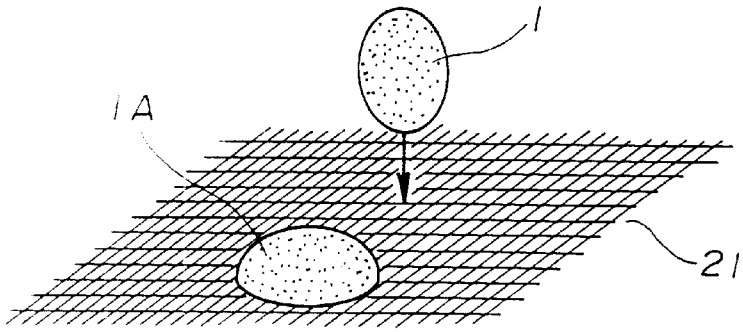
Figure 3C:
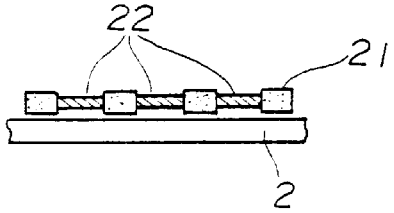

FIGS. 3A–3C show the construction of an ink-jet image recording apparatus 20 according to a second embodiment of the present invention, wherein those parts corresponding to the parts described previously are designated by the same reference numerals and the description thereof will be omitted.

Referring to FIG. 3A, the ink-jet image recording apparatus 20 uses, instead of the polyvinyl alcohol film 3 of the previous embodiment, a mesh belt 21 such that the mesh belt 21 moves along a circuitous path defined by the feed rollers 3A and 3B and an additional feel roller 3E. Thereby, the supply roll 3C and the take-up roll 3D of the previous embodiment is eliminated.

Further, the ink-jet image recording apparatus 20 of FIG. 3A includes a container 22 containing therein polyvinyl alcohol or polyvinyl pyrrolidone in the form of a solution, and there are provided additional rollers 3F and 3G for taking up the polyvinyl alcohol solution or polyvinyl pyrrolidone solution in the container 22 and for coating the same over the mesh belt 21 via the feed roller 3E.

FIG. 3B shows the mesh belt 21 in detail.

Referring to FIG. 3B, the mesh belt 21 includes mesh openings smaller in size than the size of the ink droplet 1 and holds the polyvinyl alcohol film or polyvinyl pyrrolidone film 22 in the mesh opening as indicated in FIG. 3C. Thereby, the ink droplet 1 landed on the mesh belt 21 reacts immediately with the film 22 held in the mesh opening and forms an ink region of increased viscosity, similarly to the region 1A of FIG. 1B.

The viscous ink region 1A thus formed is then transferred to the recording paper 2.

In the present embodiment, it is also possible to use other porous medium in place of the mesh belt 21, as long as the porous medium can hold the polyvinyl alcohol film or the polyvinyl pyrrolidone film thereon and as long as the thickness of the medium is small enough that the viscous ink droplets 1A thus formed on the porous medium is transferred to the recording paper 2 immediately.

As the polyvinyl alcohol or polyvinyl pyrrolidone film is removed from the recording paper 2 after the ink-jet recording process together with the mesh belt 21 in the present embodiment, the problem of the recorded image being degraded by the resin film remaining on the recording paper 2 after the ink-jet recording process is successfully eliminated and the recorded image is retained stably on the recording paper 2 for a prolonged duration.

[Third Embodiment]

Figure 4:
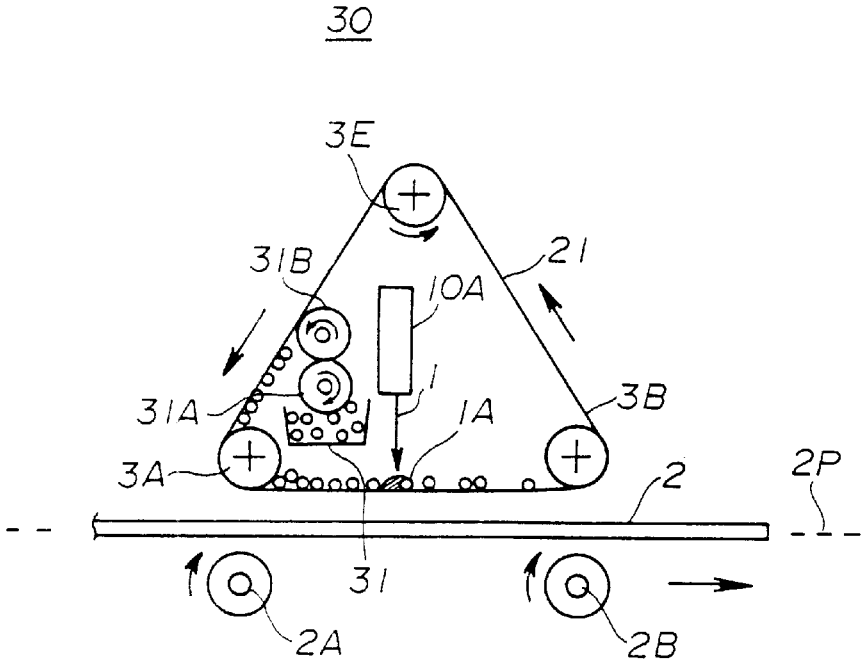
FIG. 4 is a diagram showing the principle of ink-jet recording process according to a third embodiment of the present invention.

FIG. 4 shows the construction of an ink-jet image recording apparatus 30 according to a third embodiment of the present invention, wherein those parts corresponding to the parts described previously are designated by the same reference numerals and the description thereof will be omitted.

Referring to FIG. 4, the ink-jet image recording apparatus 30 of the present embodiment has a construction similar to that of the ink-jet image recording apparatus 20 of FIG. 3A, except that fine particles of a water-soluble resin such as a polyvinyl alcohol resin, a polyvinyl pyrrolidone resin, Arabic rubber (gum arabi), a polyacrylic acid resin, or a polyacrylate resin, are held by the mesh-belt 21. Associated therewith, the container 22 and the rollers 3F and 3G for applying the liquid in the container 22 on the mesh belt 21 are eliminated, and instead, there is provided a container 31 that holds therein the foregoing water-soluble resin in the form of particles. Further, there are provided rollers 31A and 31B for picking up the particles in the container 31 and for applying the same on the mesh-belt 21.

Typically, the particles held in the container 31 have a particle size of 0.1–10 μm, more preferably 0.5–5 μm and undergo a swelling or melting when contacted with the ink droplet 1 ejected from the ink-jet head 10A. More in detail, the ink droplet 1 thus induced swelling or melting in the resin particles experiences a rapid increase in the viscosity at the marginal part thereof, and the lateral spreading of the ink beyond the initial droplet size is effectively suppressed.

Particularly, it was found that the particles of electrolytic polymers and electrolytic polymer salts, such as polyacrylic acids or polyacrylates, undergo a very fast melting when contacted with a water-color ink droplet and a rapid increase of viscosity is induced in the ink droplet. Further, it was found that, after contact with the water-color ink droplets, the electrolytic polymers or electrolytic polymer salts become insoluble to water, and the ink image thus formed on the recording paper 2 is retained without decay even when the recording paper 2 is dipped into water after the ink-jet recording of the image.

Further, it was found that the particles of polymer absorber, such as the one supplied from Nippon Shokubai K.K., is suitable for the purpose of the present invention, as such polymer absorber shows a rapid swelling when contacted with a water-color ink droplet and induces a rapid increase of viscosity in the ink droplet. Further, the polymer absorber is stable against moisture and can be held in the ink-jet recording apparatus for a prolonged duration. In addition, the use of polymer absorber is advantageous in the point that the amount of the polymer absorber necessary for causing the increase of ink viscosity is extremely small.

Figure 5A:
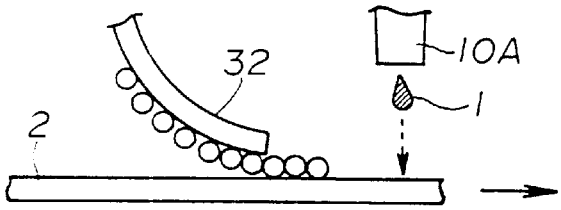
FIGS. 5A–5C are diagrams showing various modifications of the third embodiment.
Figure 5B:
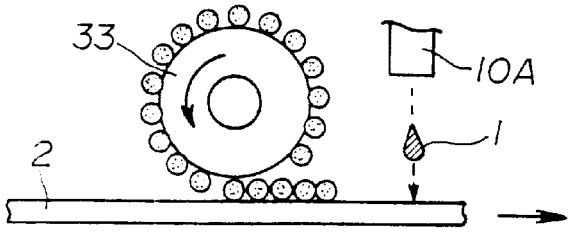
Figure 5C:
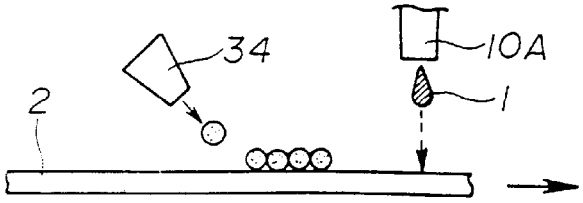

FIGS. 5A–5C show various modifications of the ink-jet printer 30 of the third embodiment, wherein FIG. 5A shows the construction in which the mesh belt 21 of FIG. 4 is eliminated and a porous elastic blade 32 is provided in place therefor for coating the surface of the recording paper 2 with the resin particles at an upstream side of the location of the paper feed path 2P in which the ink-jet recording is made by the ink-jet head 10A.

FIG. 5B, on the other hand, shows a modification in which a porous elastic roller 33 is used for coating the surface of the recording paper 2 by the resin particles at the upstream side of the ink-jet head 10A. Typically, a roller of silicone rubber or butyl rubber is used for the roller 33.

Further, FIG. 5C shows a modification in which the resin particles are sprayed on the recording paper 2 by a spray nozzle 34 also at the upstream side of the ink-jet head 10A.

In a preferred example of using, in the construction of FIG. 5A, the particles of polyacrylic acid having an average diameter of about 1 $\mu$m it was confirmed that a clear, sharply defined image is recorded on the recording paper 2 even when an ordinary recording paper for use in xerographic copiers and printers is used for the recording paper 2. The quality of the image thus obtained on the ordinary recording paper was substantially identical with the quality when the ink-jet recording was made on a special recording paper specially produced for ink-jet recording.

As noted already, the resin to be used in combination with a water-color ink is a water-soluble resin and includes the particles of polyvinyl alcohol, polyvinyl pyrrolidone, Arabic rubber (gum arabi), polyacrylic acid, or polyacrylate. Further, a polymer absorber may also be used. When the ink is an oily ink, on the other hand, the resin to be used in combination with the ink includes the particles of petroleum resin, DCPD resin, rosin modified phenol resin, arachid resin, and the like.

[Fourth Embodiment]

Figure 6A:
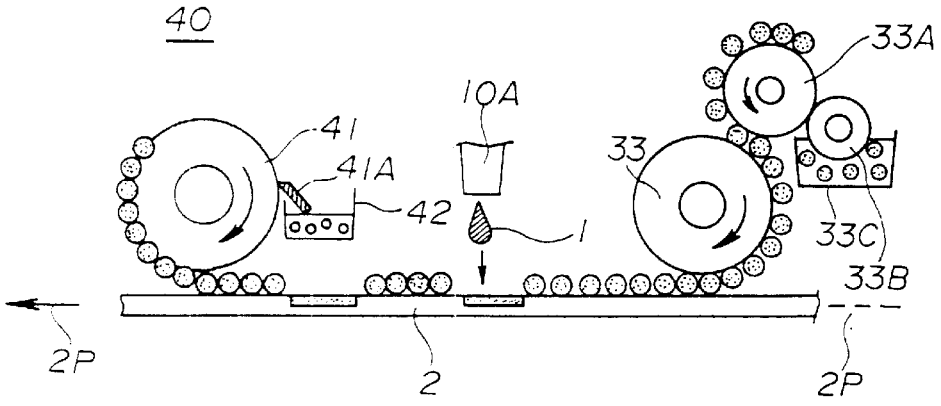
FIGS. 6A and 6B are diagrams showing the construction of an ink-jet recording apparatus according to a fourth embodiment of the present invention.
Figure 6B:
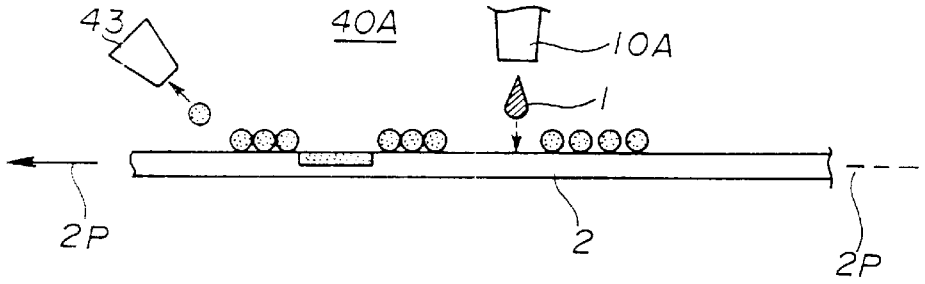

FIGS. 6A and 6B show an ink-jet image recording apparatus 40 and 40A according to a fourth embodiment of the present invention, wherein those parts corresponding to the parts described previously are designated by the same reference numerals and the description thereof will be omitted.

Referring to FIG. 6A, the ink-jet image recording apparatus 40 has a construction similar to that of the apparatus 30 of FIG. 4 except that the resin particles are applied on the recording paper 2 by the porous elastic roller 33, which in turn receives the resin particles in a container 33C via intermediate rollers 33B and 33A.

Further, the ink-jet image recording apparatus 40 includes a recovery roller 41 at the downstream side of the ink-jet head 10A for recovering the particles remaining on the paper 2 without being reacted with the, ink droplet 1. Typically, the recovery roller 41 is formed of an elastic porous material such as a silicone rubber, and the recording paper 2 is fed to a recovery tray (not shown) of the ink-jet image recording apparatus 40 in the state that the resin particles are removed. By removing the resin particles, the problem of the remaining resin particles on the paper 2 causing a reaction with water or oil after the ink-jet image recording, is successfully eliminated, and the durability of the recording is improved substantially.

The resin particles thus collected on the recovery roller 41 are scraped off by a blade 41 and are collected into a recovery container 42.

The apparatus 40A of FIG. 6B is a modification of the apparatus 40 and collects the resin particles by using a suction nozzle 43. Otherwise, the construction is identical with that of the apparatus 40 and the description thereof will be omitted.

Figure 7:
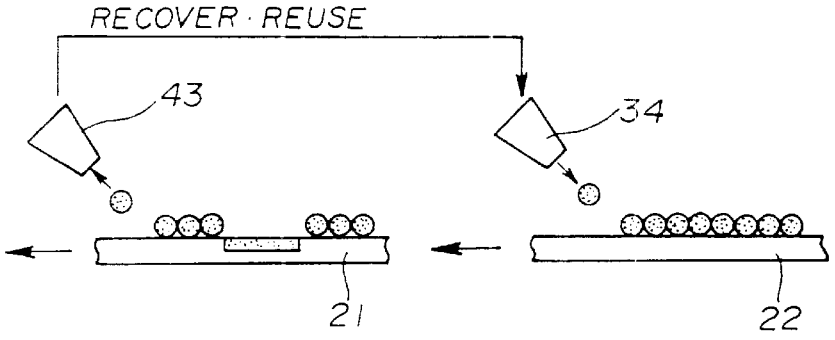
FIG. 7 is a diagram showing a modification of the fourth embodiment.

FIG. 7 shows a further modification of the present embodiment, wherein the resin particles recovered by the nozzle 43 from a recording paper $\mathbf{2}_1$ is. reused in the next recording paper $\mathbf{2}_2$ by feeding the recovered resin particles to the spray nozzle 34.

[Fifth Embodiment]

Figure 8:
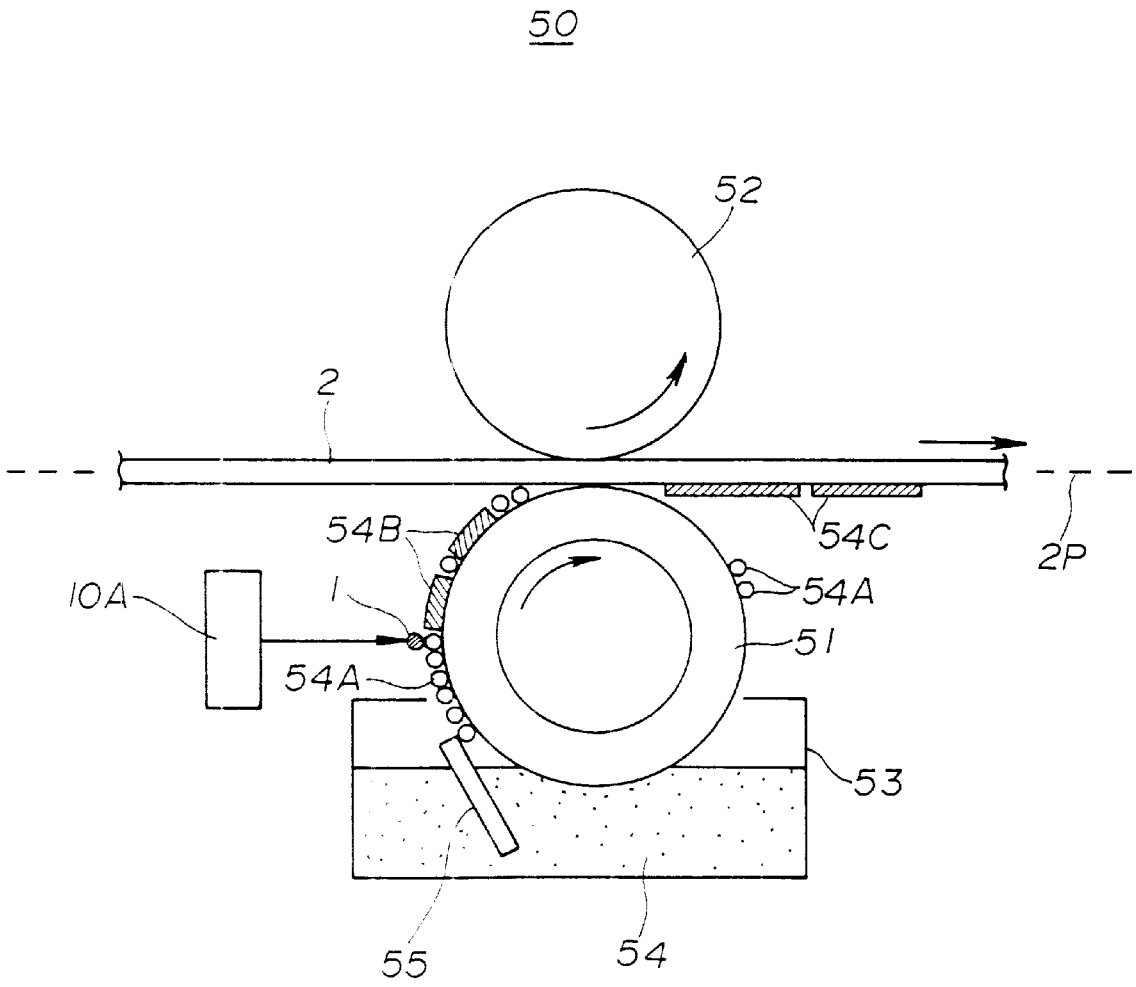
FIG. 8 is a diagram showing the construction of an ink-jet recording apparatus according to a fifth embodiment of the present invention.

FIG. 8 shows the construction of an ink-jet image recording apparatus 50 according to a fifth embodiment of the present invention, wherein those parts corresponding to the parts described previously are designated by the same reference numerals and the description thereof will be omitted.

Referring to FIG. 8, the ink-jet image recording apparatus 50 includes an image transfer roller 51 and an adjacent sheet feed roller 52 disposed at both sides of the recording paper 2 on the paper feed path 2P, such that the image transfer roller 5 and the sheet feed roller 52 engage with each other across the recording paper 2. Further, the ink-jet recording head 10A is disposed at the side of the image transfer roller 51 and records an ink-jet image on the surface of the image transfer roller 51 by impinging the ink droplets 1.

Further, the construction of FIG. 8 includes a container 53 holding the particles 54 of a substance that undergoes a swelling or melting when contacted with the ink droplet 1, wherein the container 53 is disposed such that the particles 54 in the container 53 make a contact with the surface of the image transfer roller 51. Typically, the image transfer roller 51 is formed of a silicone rubber or a butyl rubber having a sticky surface, and the particles 54 form a thin layer 54A on the surface of the image transfer roller 51 as the roller 51 is rotated. In order to assist the formation of the thin layer 54A of the particles 54 on the image transfer roller 51, the container 53 includes a coating blade 55 therein such that a minute gap is formed between the edge of the coating blade 55 and the surface of the image transfer roller 51.

When the ink used for the ink droplet 1 is a water-color ink, it is preferable to use any of a polymer electrolyte, polymer electrolytic salt or a polymer absorber described before for the particles. When the ink is an oily ink, on the other hand, it is preferable to use any of the petroleum resin, DCPD resin, rosin modified phenol resin, or arachid resin.

As a result of the use of the foregoing resin particles for the particles 54, there is formed a viscous ink image 54B on the surface of the image transfer roller 51, and the viscous ink image 54B thus formed is transferred to the recording paper 2 in the form of a fixed ink image 54C. As the ink image 54B is a viscous ink image, the problem of spreading or diffusion of the ink into the fibrous texture of the recording paper 2 is successfully avoided even when an ordinary paper is used for the recording paper 2. The fixed ink image 54C on the paper 2 is stable against moisture or water, and the ink image thus recorded on the paper 2 is substantially free from decaying.

In the construction of FIG. 8, it should be noted that the particles 54A not contacted with the ink droplet 1 remain on the sticky surface of the image transfer roller 51. Thus, the recording paper 2 is substantially free from the particles 54A after the ink image 54C is fixed thereon, and the problem of decaying of the recorded ink image as a result of accidental contact of the paper 2 with water or oil is effectively suppressed.

In the construction of FIG. 8, it is also possible to form the ink image 54C on the recording paper 2 in the state that the ink image 54C is projecting from the surface of the paper 2, while such a projecting ink image provides an ornamental effect and also assists a handicapped person to recognize the recorded image. This feature applies also to other embodiments of the present invention.

[Sixth Embodiment]

Figure 9:
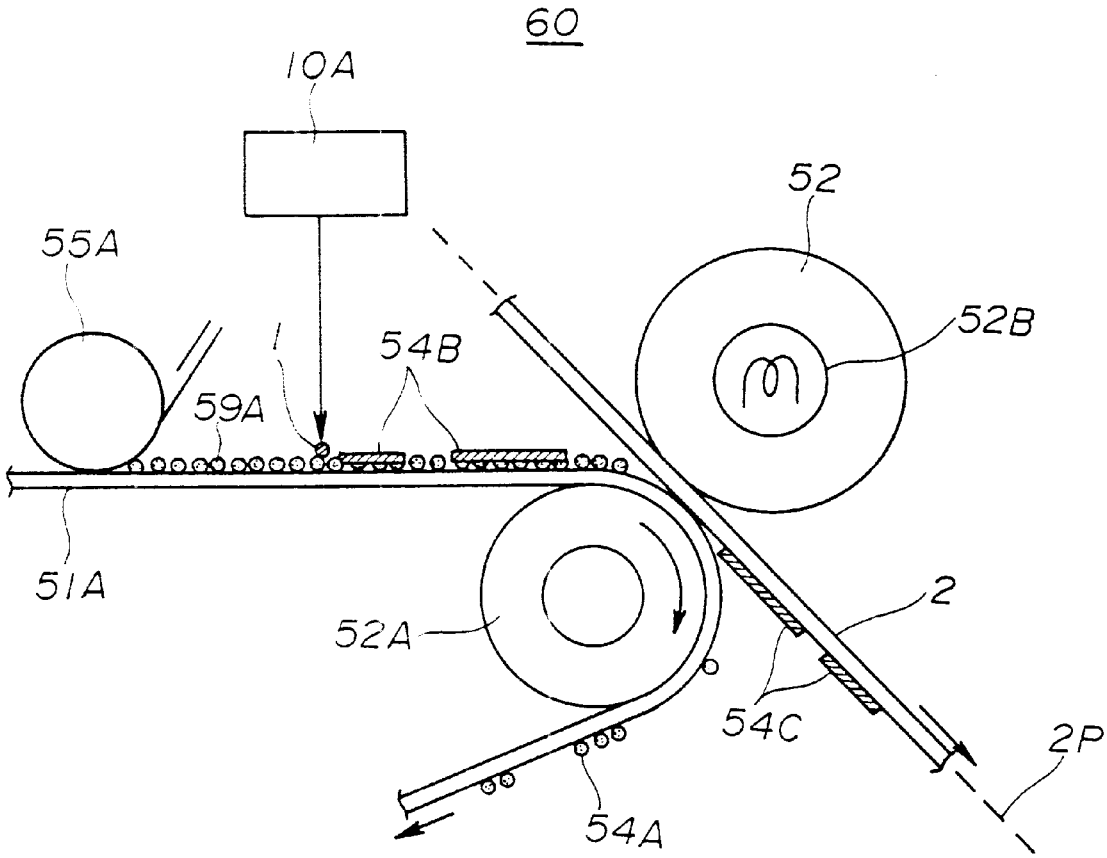
FIG. 9 is a diagram showing the construction of an ink-jet recording apparatus according to a sixth embodiment of the present invention.

FIG. 9 shows the construction of an ink-jet recording apparatus 60 according to a sixth embodiment of the present invention, wherein those parts corresponding to the parts described previously are designated by the same reference numerals and the description thereof will be omitted.

Referring to FIG. 9, the ink-jet image recording apparatus 60 uses a pair of feed rollers 52 and 52A for feeding the recording paper 2 along the paper feed path 2P, wherein the image transfer roller 51 of the previous embodiment is replaced by an image transfer belt 51A, typically of a material such as silicone rubber or butyl rubber having a sticky surface, and the particles 54A of the resin that causes a swelling or melting upon contact with the ink droplet 1 is supplied on the belt 51A from the container 53 not illustrated, wherein the resin particles 54A are coated to form a layer by a roller 55A.

In the ink-jet image recording apparatus 60, the ink-jet head 10A is disposed above the belt 51A and elects the ink droplets 1 on the belt 51A carrying thereon the resin particles 54A. Thereby, there is formed a viscous ink image 54B on the belt 51A and the viscous ink image 54B thus formed is transferred to the recording paper 2 as the recording paper 2 is pressed against the belt 51A by the feed rollers 52 and 52A. The feed roller 52 further includes therein a heating mechanism 52B such as a halogen lamp, and the viscous ink image 54B thus transferred to the recording paper 2 is fixed immediately to form a fixed ink image 54C.

In the present embodiment, too, it is possible to carry out the ink-jet image recording without causing spreading or diffusion of the ink image into the fibrous texture of the recording paper 2, even in such a case in which ordinary recording paper is used for the paper 2.

[Seventh Embodiment]

Figure 10:
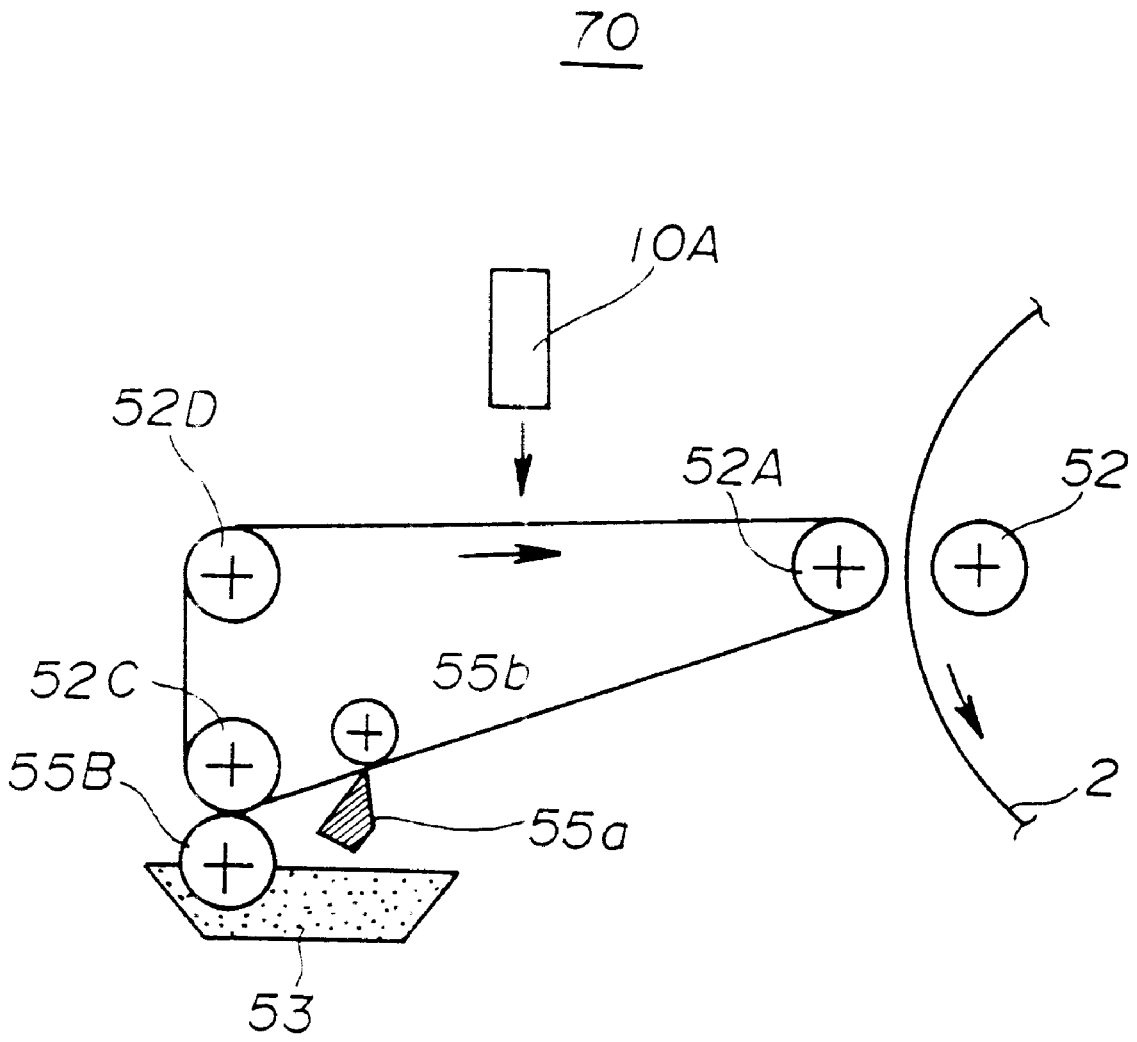
FIG. 10 is a diagram showing the construction of an ink-jet recording apparatus according to a seventh embodiment of the present invention.

FIG. 10 shows the construction of an ink-jet image recording apparatus 70 according to a seventh embodiment of the present invention, wherein those parts corresponding to the parts described previously are designated by the same reference numerals and the description thereof will be omitted.

Referring to FIG. 10, the ink-jet image recording apparatus 70 of the present embodiment is a modification of the apparatus 60 and holds the image transfer belt 51A by the feed roller 52A and additional feed rollers 52C and 52D, wherein there is provided a powder coating roller 55B in engagement with the feed roller 52C for coating the surface of the image transfer belt 51A with the particles in the container 53. Further, there is provided a blade 55*a* in engagement with a cooperating roller 55*b* across the belt 51A so as to scrape off the particles from the surface of the belt 51A. The blade 55*a* is provided such that the scraped particles are recovered into the container 53.

Otherwise, the image recording apparatus 70 is substantially identical with the image recording apparatus 60 and further description thereof will be omitted.

[Eighth Embodiment]

Figure 11A:
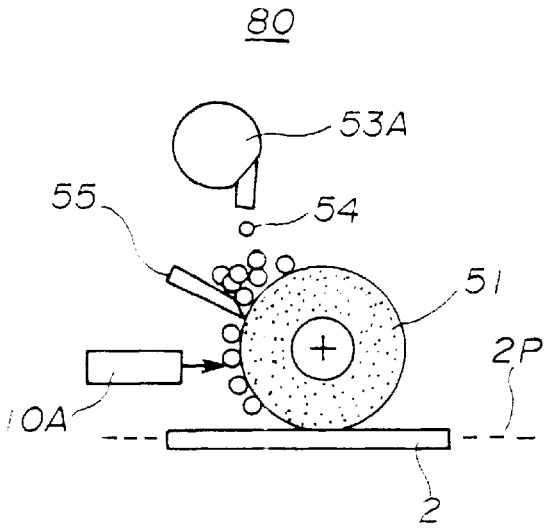
FIGS. 11A and 11B are diagrams showing the construction of an ink-jet recording apparatus according to an eighth embodiment of the present invention.

FIG. 11A shows a part of an ink-jet image recording apparatus 80 according to an eighth embodiment of the present invention, wherein those parts corresponding to the parts described previously are designated by the same reference numerals and the description thereof will be omitted.

Referring to FIG. 11A, the ink-jet image recording apparatus 80 is a modification of the apparatus 50 of FIG. 8, wherein the ink-jet head 10A and the image transfer roller 51 are provided above the paper feed path 2P, and the resin particles 54 are dropped on the surface of the image transfer roller 51 from a feeding mechanism 53A disposed above the roller 51. Further, there is provided a blade 55C for coating the surface of the image transfer roller 51 by the thin layer of the resin particles 54. Thereby, the ink-image is recorded on the image transfer roller 51 by the ink droplets 1 ejected from the ink-jet head 10A, wherein the ink droplets 1 thus reached the surface of the image transfer roller 51 experience the rapid increase of viscosity, and the viscous ink image thus formed is transferred to the recording paper 2 without causing substantial spreading or diffusion of the ink.

Figure 11B:
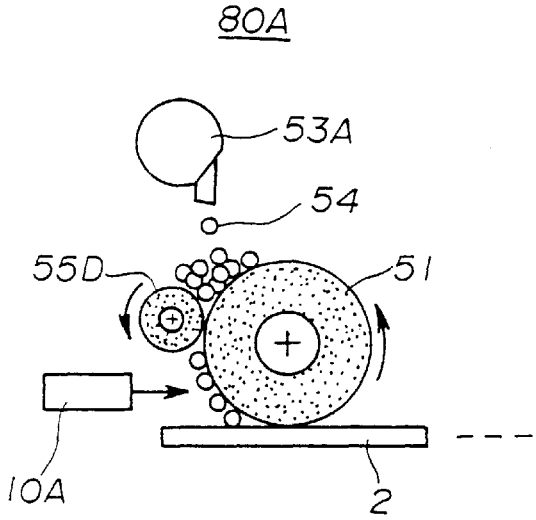

FIG. 11B shows an ink-jet image recording apparatus 80A which is a modification of the apparatus 80 of FIG. 11A.

Referring to FIG. 11B, the apparatus 80A uses a reverse roller 55D for coating the surface of the image transfer roller 51 with the resin particles 54 in place of the coating blade 55C. Otherwise, the ink-jet image recording apparatus 80A is identical with the apparatus 80 of FIG. 11A.

[Ninth Embodiment]

Figure 12:
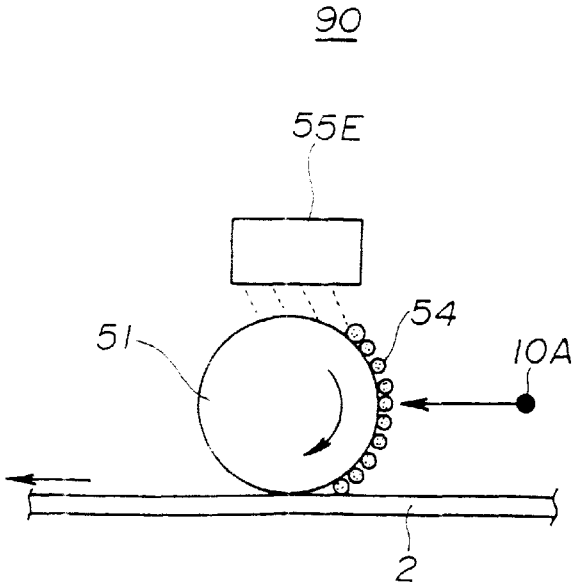
FIG. 12 is a diagram showing the construction of an ink-jet recording apparatus according to a ninth embodiment of the present invention.

FIG. 12 shows the construction of an ink-jet image recording apparatus 90 according to a ninth embodiment of the present invention, wherein those parts corresponding to the parts described previously are designated by the same reference numerals and the description thereof will be omitted.

Referring to FIG. 12, the ink-jet image recording apparatus 90 is a modification of the ink-jet image recording apparatus 80 or 80A in that the resin particles 54 are provided on the image transfer roller 51 and the ink-jet image is formed on the roller 51 by way of the ink droplets 1 from the ink-jet recording head 10A.

In the present embodiment, it should be noted that there is provided an electrostatic charger 55E above the image transfer roller 51 for charging the resin particles 54 to a first polarity and the surface of the roller 51 to a second, opposite polarity. Thereby, the resin particles 54 cover the surface of the roller 51 by an electrostatic interaction.

Further, in any of the preceding embodiments, it is possible to use colored resin particles for the resin particles 54. In such a case, the ink-jet recording head 10A may eject water droplets in place of the ink droplets 1.

Further, the present invention is by no means limited to the embodiments described heretofore, but various variations and modifications may be made without departing from the scope of the invention.

What is claimed is:

1. An ink-jet image recording apparatus, comprising:

a sheet feed mechanism feeding a recording sheet along a sheet feed path;

an ink-jet recording head provided in said sheet feed path so as to record an image on said recording sheet transported through said sheet feed path, by projecting ink droplets to said recording sheet;

an ink viscosity adjusting mechanism provided in said sheet feed path, said ink viscosity adjusting mechanism providing a substance layer on said recording sheet at an upstream side of said ink-jet recording head, such that said ink-jet recording head records said image through said substance layer;

said ink viscosity adjusting mechanism further removing said substance layer from said recording sheet at a downstream side of said ink-jet recording head after said image is recorded on said recording sheet through said substance layer.

2. An ink-jet image recording apparatus as claimed in claim 1, wherein said substance is selected from a group consisting of: polyvinyl alcohol; polyvinyl pyrrolidone; gum arabi; polyacrylic acid; and polyacrylate.

3. An ink-jet image recording apparatus as claimed in claim 1, wherein said substance is selected from a group consisting of: a petroleum resin, a DCPD resin; a rosin modified phenol resin; and an arachid resin.

4. An ink-jet image recording apparatus as claimed claim 1, wherein said ink viscosity adjusting mechanism includes a feed roller feeding a film of said substance, guide rollers for guiding said film to said recording sheet so as to make a contact with said recording sheet in a part of said recording sheet on which said record of said image is made by said droplets from said ink-jet recording head, as said substance layer, and a take-up roller for taking up said film.

5. An ink-jet image recording apparatus as claimed in claim 1, wherein said ink viscosity adjusting mechanism includes: a porous belt moved along a circuitous path; guide rollers for guiding said porous band so as to make a contact with said recording sheet in a part of said recording sheet on which said record of said image is made by said droplets from said ink-jet recording head; and an infiltration device provided adjacent to said porous belt, said infiltration device infiltrating said porous belt with a solution of said substance.

6. An ink-jet image recording apparatus as claimed in claim 1, wherein said ink viscosity adjusting mechanism includes: a coating device provided at an upstream side of said sheet feed path with respect to said ink-jet recording head, said coating device coating a surface of said recording sheet, on which an image is to be recorded, by particles of said substance; and a recovery device provided at a downstream side of said sheet feed path with respect to said ink-jet recording head, said recovery device collecting said particles from said surface of said recording sheet.

7. An ink-jet image recording apparatus as claimed in claim 6, wherein said coating device is a coating blade disposed adjacent to said recording sheet in said sheet feed path.

8. An ink-jet recording apparatus as claimed in claim 6, wherein said coating device is a coating roller provided in contact with said surface of said recording sheet.

9. An ink-jet recording apparatus as claimed in claim 6, wherein said coating device is a spray nozzle spraying said particles on said surface of said recording sheet.

10. An ink-jet recording apparatus as claimed in claim 6, wherein said recovery device is a recovery roller provided in contact with said surface of said recording sheet.

11. An ink-jet recording apparatus as claimed in claim 6, wherein said recovery device is a suction nozzle disposed adjacent to said surface of said recording sheet for collecting said particles.

12. An ink-jet recording apparatus as claimed in claim 11, wherein said suction nozzle feeds said particles collected from said surface of said recording sheet to said spray nozzle.

13. An ink-jet image recording apparatus, comprising:

a sheet feed mechanism feeding a recording sheet along a sheet feed path;

an image transfer medium disposed in said sheet feed path so as to make a contact with said recording sheet transported through said sheet feed path, said image transfer medium being moved along a circuitous path;

an ink-jet recording head provided adjacent to said image transfer medium so as to record an image thereon, by projecting ink droplets to said image transfer medium;

an ink viscosity adjusting mechanism provided on said image transfer medium, said ink viscosity adjusting mechanism providing a substance layer on said image transfer medium at an upstream side of said circuitous path with respect to said ink-jet recording head, such that said ink-jet recording head records said image on said image transfer medium through said substance layer, wherein said substance layer increases a viscosity of said ink droplet when contacted with said ink droplet.

14. An ink-jet image recording apparatus as claimed in claim 13, wherein said substance is selected from a group consisting of: polyvinyl alcohol; polyvinyl pyrrolidone; gum arabi; polyacrylic acid; and polyacrylate.

15. An ink-jet image recording apparatus as claimed in claim 13, wherein said substance is selected from a group consisting of: a petroleum resin, a DCPD resin; a rosin modified phenol resin; and an arachid resin.

16. An ink-jet image recording apparatus as claimed in claim 13, wherein said image transfer medium is a roller, and wherein said ink viscosity adjusting mechanism provides said substance layer on a surface of said roller.

17. An ink-jet image recording apparatus as claimed in claim 13, wherein said image transfer medium is a belt, and wherein said ink viscosity adjusting mechanism provides said substance layer on a surface of said belt.

* * * * *